US005366857A

United States Patent [19]

Pitt et al.

[11] Patent Number: 5,366,857

[45] Date of Patent: Nov. 22, 1994

[54] HYDROPHILIC COLLOID COMPOSITION FOR A PHOTOGRAPHIC MATERIAL

[75] Inventors: Alan R. Pitt, Sandridge; Bernard A. Clark, Maidenhead; John F. Padday, Beaconsfield, all of United Kingdom

[73] Assignee: Eastman Kodak Company, Rochester, N.Y.

[21] Appl. No.: 952,719

[22] PCT Filed: May 11, 1991

[86] PCT No.: PCT/EP91/00898

§ 371 Date: Nov. 13, 1992

§ 102(e) Date: Nov. 13, 1992

[87] PCT Pub. No.: WO91/18321

PCT Pub. Date: Nov. 28, 1991

[30] Foreign Application Priority Data

May 16, 1990 [GB] United Kingdom ..... 9010967

[51] Int. Cl.[5] ..... G03C 1/38

[52] U.S. Cl. ..... 430/631; 430/539; 430/637; 430/642; 430/643; 252/351

[58] Field of Search ..... 430/539, 640, 643, 631, 430/637, 642; 106/4; 252/351, 356; 525/271; 526/250; 528/299, 301

[56] References Cited

U.S. PATENT DOCUMENTS 3,470,258 9/1969 Tesoro .

FOREIGN PATENT DOCUMENTS 0111338 6/1984 European Pat. Off. .
0240601 10/1987 European Pat. Off. .
A1366692 9/1974 United Kingdom .
1524631 9/1978 United Kingdom .
8300162 1/1983 WIPO .

OTHER PUBLICATIONS

"Waterproofing and Water-repellancy", J. L. Moillet, 1963, Elsevier Publishing Co., London, p. 142.

*Primary Examiner*—Thorl Chea
*Attorney, Agent, or Firm*—Edith A. Rice

[57] ABSTRACT

A coating composition suitable for use in the preparation of a photographic material comprises an aqueous solution of a hydrophilic colloid and a surface active coating aid having the formula $$CF_3(CF_2)_nCH_2O(\text{glycidyl})_mH$$

wherein
n is an integer from 4 to 7; and,
m is an integer from 6 to 45.

4 Claims, No Drawings

HYDROPHILIC COLLOID COMPOSITION FOR A PHOTOGRAPHIC MATERIAL

The invention relates to a hydrophilic colloid composition for a photographic material. More particularly, it relates to a hydrophilic colloid coating composition containing a fluoroalkyl polyglycidol surface active agent which may be used in the preparation of a photographic material.

In the preparation of a photographic material, a support is usually coated with one or more layers comprising an aqueous solution of a hydrophllic colloid binder e.g. gelatin. Such layers include, for example, silver halide emulsion layers, intermediate layers, antihalation layers, filter layers, antistatic layers, protective layers, and the like. For multilayer materials, the layers may be coated simultaneously.

In the preparation of hydrophilic colloid layers, the coating solutions must be coated uniformly with a minimum of repellency spots, or repellencies. A repellency is a coating unevenness, such as a round, oval, or comet-shaped indentation or crater in the layer or layers. Repellencies are often caused by the presence in the coating composition of finely-divided insoluble materials in the form of addenda, impurities, or contaminants that are surface active. Solutions coated in the preparation of photographic materials often contain dispersed insoluble photographic addenda, such as organic solvents, or addenda to alter certain physical properties, such as lubricants. Many of these addenda are capable of imparting repellencies to coated layers.

Photographic gelatin may contain insoluble residues of certain naturally-occurring animal fats and fatty acids which can impart repellencies to the coated layer. Also, surface active contaminants may be introduced from external sources during preparation of the coating composition or during coating. For example, a layer may be contaminated during or immediately after coating by various oils used to lubricate the coating apparatus or by other airborne surface active particles.

A wide variety of ionic and non-ionic surface active agents have been suggested for use as coating aids to control the uniformity of hydrophilic colloid layers. Ionic e.g. anionic surface active agents can produce unwanted ionic interactions in hydrophilic colloid coating compositions. For example, anionic surface active agents tend to be incompatible with cationic polymers and tend to cause such problems as clouding or precipitation; they also tend to cause large increases in viscosity when added to gelatin solutions and they tend to result in a hydrophobic surface which is not readily wettable.

The use of non-ionic surface active agents can overcome the results of unwanted ionic interactions. For example, U.K. Patent No. 1,524,631 describes the use of certain non-ionic fluoroalkyl polyalkylkeneoxides and polyglycidols as coating aids for use in the preparation of photographic materials. The coating aids are represented by the general formula $$H(CF_2CF_2)_kCH_2O—[A]H$$

wherein k is an integer from 2 to 10 and A represents certain polyalkylene oxide or polyglycidyl groups. These compounds, however, do not prevent repellencies caused by materials having low surface tension properties, such as silicone fluids used as lubricants and sealants.

In addition to controlling repellencies, surface active agents can affect the electrical charging characteristics of a hydrophilic colloid layer. Dried coatings of aqueous gelatin or aqueous gelatin solutions containing conventional hydrocarbon-based surface active agents charge positively when impacted against surfaces such as stainless steel. Negative charge inducing surface active agents can be incorporated in the coating composition to produce a dried gelatin coating that has a desired charging characteristic. Such measures are of use in minimising the accumulation of electrostatic charge in coated hydrophilic colloid layers.

The invention aims to provide surface active agents for hydrophilic colloid coating compositions which are capable of improved repellency control and have desirable charge control characteristics.

In one aspect, the invention provides a coating composition comprising an aqueous solution of a hydrophilic colloid and a surface active agent present as a coating aid characterised in that the surface active agent has the formula $$CF_3(CF_2)_nCH_2O(\text{glycidyl})_mH$$

wherein n is an integer from 4 to 7; and, m is an integer from 6 to 45.

The invention also provides a method of making a product e.g. a photographic material comprising one or more layers of a hydrophilic colloid composition coated on a support which method comprises coating the support with one or more layers of a hydrophilic colloid coating composition and drying said layer or layers characterised in that at least one of the layers is coated from a coating composition of the invention.

In a more particular aspect, the invention provides a photographic material comprising a support and at least one hydrophilic colloid layer including at least one light-sensitive silver halide emulsion layer, characterised in that at least one hydrophilic colloid layer comprises a surface active agent having the formula $$CF_3(CF_2)_nCH_2O(\text{glycidyl})_mH$$

wherein n is an integer from 4 to 7; and, m is an integer from 6 to 45.

The fluoroalkyl group has a terminal —$CF_3$ group in contrast to the fluoroalkyl group of the prior art compounds which has a terminal —$CF_2H$ group.

Polyglycidyl groups are well-known and described, for example, in U.S. Pat. No. 3,514,293. The glycidyl group is a hydroxypropylene ether group having the formula $C_3H_6O_2$. Polyglycidyl groups are formed by the condensation of glycidol and comprise a random mixture of repeating groups of the formula $$-(CH_2\underset{\underset{CH_2OH}{|}}{CHO})- \quad \text{and} \quad -(CH_2\underset{\underset{OH}{|}}{CH}CH_2O)-$$

The surface active agents used in the present invention are obtainable from the reaction of a fluoroalcohol having the formula $CF_3(CF_2)_nCH_2OH$ with an appropriate molar proportion of glycidol, the molar ratio of glycidol:fluoroalcohol being in the range 6:1 to 45:1.

Thus, in the structural formula given for the surface active agent, m represents the number of moles of glycidol that are reacted with one mole of the fluoroalcohol.

Preferred surface active agents have the structural formula given above wherein n is 5 and m is an integer from 10 to 20.

The concentrations at which the surface active agents of the invention are used depends upon such factors as the nature of the repellency-forming material, the degree of static control required and whether other surface active agents are present. However, the preferred range of concentration of surface active agent is from 0.01 to 0.5, more preferably from 0.02 to 0.3, percent by weight of the coating solution.

The preferred hydrophilic colloid is gelatin e.g., alkali-treated gelatin (cattle bone or hide gelatin), acid-treated gelatin (pigskin gelatin), de-ionised gelatin or a gelatin derivative e.g. acetylated gelatin or phthalated gelatin. Other hydrophilic colloids useful in the invention include naturally-occurring substances, such as proteins, protein derivatives, cellulose derivatives (e.g., cellulose esters) polysacchartdes (e.g., dextran, gum arabic, zein, casein, and pectin), collagen derivatives, agar-agar, arrowroot, and albumin. Examples of synthetic hydrophilic colloids useful in the invention include polyvinyl alcohol, acrylamide polymers, maleic acid copolymers, acrylic acid copoylmers, methacrylic acid copolymers, and polyalkylene oxides.

The photographic composition of the invention may be used to coat any layer of a photographic material. Such layers are well-known in the art, and include silver halide emulsion layers, intermediate layers, antihalation layers, filter layers, antistatic layers, protective layers, and others as described in *Research Disclosure,* Item 17643, December, 1978 [hereinafter referred to as *Research Disclosure*]. In a preferred embodiment, the composition of the invention is coated as the outermost layer e.g. a protective overcoat of s photographic material.

The coating and drying of the hydrophilic colloid layers may be carried out in accordance with any of the procedures described in *Research Disclosure* Section XV.

The surface active agents used in the present invention may be used in combination with other surface active agents. In order to control static charging, it may be advantageous to employ a combination of a negative charge inducing surface active agent used in the invention and a positive charge inducing surface active agent e.g. a hydrocarbon-based compound. The positive charge inducing compound may also be a coating aid. Examples of coating aids are described in *Research Disclosure* Section XI.

Photographic materials with which the invention can be used may comprise a negative-working or positive-working silver halide emulsion layer. Suitable emulsions and their preparation are described in *Research Disclosure* Section 1 and II and the publications cited therein. Suitable vehicles for the emulsion layers and other layers of photographic materials are described in *Research Disclosure* Section IX and the publications cited therein.

For color photographic materials, references giving information on couplers and on methods for their dispersion are given in Sections VII and XIV, respectively, of *Research Disclosure.* An account of dye-forming development is given in 'Modern Photographic Processing', Vol. 2, Grant Haist, Wiley, New York, 1978, Chapter 9.

The photographic materials useful in the practice of the invention, or individual layers thereof, can contain brighteners (see *Research Disclosure* Section V), antifoggants and stabilizers (see *Research Disclosure* Section VI), antistain agents and image dye stabilizers (see *Research Disclosure* Section VII, paragraphs I and J), light absorbing and scattering materials (see *Research Disclosure* Section VIII), hardeners (see *Research Disclosure* Section X), pasteurizers and lubricants (see *Research Disclosure* Section XII), antistatic agents (see *Research Disclosure* Section XIII), matting agents (see *Research Disclosure* Section XVI), and development modifiers (see *Research Disclosure* Section XXI).

The photographic materials can be coated on a variety of supports as described in *Research Disclosure* section XVII and the references described therein.

The photographic materials can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Development is followed by the conventional steps of bleaching, fixing, or bleach-fixing, to remove silver and silver halide, washing and drying.

The surface active agents used in the present invention are known compounds. They may be prepared by reacting a fluoroalcohol with glycidol. For example, in the preparation of the surface active agent having the structural formula given above wherein n=5 and m=10, glycidol was added dropwise to a mixture of $CF_3(CF_2)_5CH_2OH$ and triethylamine catalyst under a stream of nitrogen maintaining the temperature at 115°-125° C. The glycidol:fluoroalcohol molar ratio was 10:1. After stirring for several hours, the desired fluoroalkyl polyglycidyl product was recovered.

The invention is further illustrated by way of example as follows. The compounds tested are represented by the following formula $$R{-}CH_2O{-}(CH_2\underset{\underset{CH_2OH}{|}}{C}HO)_p{-}(CH_2\underset{\underset{OH}{|}}{C}HCH_2O)_q{-}H$$

wherein p+q is the number of moles of glycidol that were reacted with the parent fluoroalcohol, R—$CH_2OH$, to produce the fluoroalkyl polyglycidyl compound.

| | R | p + q |
|---|---|---|
| Compound A (invention) | $CF_3(CF_2)_5$ | 10 |
| Compound A' (invention) | $CF_3(CF_2)_5$ | 15 |
| Compound B (comparison) | $HCF_2(CF_2)_5$ | 10 |
| Compound B' (comparison) | $HCF_2(CF_2)_5$ | 8 |
| Compound C (invention) | $CF_3(CF_2)_6$ | 25 |
| Compound D (invention) | $CF_3(CF_2)_7$ | 35 |
| Compound E (comparison) | $HCF_2(CF_2)_7$ | 20 |

EXAMPLE 1

The ability of a coating aid to control repellencies caused by an aqueous-based surface active contaminant arising from an external source during the coating process was tested as follows.

Two gelatin layers, the uppermost of which contained the coating aid under test, were coated onto a polyethylene terephthalate film base subbed to give adhesion to gelatin. The bottom layer consisted of a 4% by weight solution of lime-processed bone gelatin in water coated at 85.4 ml/m$^2$. The top layer consisted of a 7% by weight solution of lime-processed bone gelatin in water containing a colored dye marker. The top layer was applied at a coverage of 14.2 ml/m$^2$. Both layers were applied simultaneously at a temperature of 40° C. using a conventional double slide hopper with applied suction and a linear coating speed of 15 m/min.

A drop of a concentrated nonionic surfactant solution (25% by weight in water) representing a contaminant was introduced directly onto the top layer by placing it on the surface using a platinum loop-shaped wire. The contaminant was applied at approximately 15 cm from where the layers were applied to the support. A series of nonionic surfactants was applied in this way, each having a slightly different surface activity (i.e. minimum surface tension in a 7% by weight solution of lime-processed gelatin at 40° C. measured independently with a tensiometer by the Wilhelmy plate method).

For each series of experiments, the coating aid was used in amounts ranging from 0.2 to 0.5% by weight of the top layer solution. By examining which surface active contaminants produced repellencies in the coating and which did not, a measure was obtained of the extent to which the coating aid provided protection against repellencies from an external source.

The results are summarised in Table I below.

TABLE 1

| Compound | Concn. (wt. %) | Surface Tension Minimum (mN/m) produced by contaminant 22 | 24 | 26.5 | 29 | 31 | 34 | 36 | 38 | 40 |
|---|---|---|---|---|---|---|---|---|---|---|
| A | 0.2 | | | | | R | R | C | C | C |
| (inv.) | 0.3 | R | R | R | C | C | | | | |
| | 0.4 | R | R | R | C | | | | | |
| | 0.5 | C | C | | | | | | | |
| B | 0.2 | | | | | | | R | R | R |
| (comp.) | 0.3 | | | | | | R | R | R | C |
| | 0.4 | | | | | R | R | C | C | C |
| | 0.5 | | | | R | R | R | C | C | |
| D | 0.3 | R | C | | | | | | | |
| (inv.) | 0.4 | C | C | | | | | | | |
| E | 0.3 | R | R | | | | | | | |
| (comp.) | 0.4 | R | | | | | | | | |
| | 0.5 | R | | | | | | | | |

In the table, R denotes that the surface active contaminant produced a repellency while C denotes that no repellency was produced.

The results presented in Table 1 clearly demonstrate the extra protection against external sources of repellency provided by the surface active agents of the invention relative to the comparison compounds.

Although the number of glycidyl groups in comparative Compound E is less than in Compound D of the invention, the incorporation of additional glycidyl groups in Compound E would increase its solubility and hence reduce its surface activity. Therefore, the performance of Compound E in the experiments described above is better than that of the same compound having a greater number of glycidyl groups.

In fact, at concentrations below 0.5% by weight, only the compounds used in the invention are capable of preventing repellency with the 22 mN/m contaminant.

EXAMPLE 2

The ability of a coating aid to control repellencies caused by an oil-based surface active contaminant arising from an external source during the coating process was tested as follows.

Two gelatin layers were coated following the procedure of the first example, the coating aid being present in the top layer. Three surface active oily contaminants were introduced onto the coating with a platinum wire loop in the same manner described in Example 1. The oily contaminants selected for the tests were Nalco 2341 TM (an antifoam agent available from Nalco Chemical Co., Illinois, U.S.A.), WD40 TM (a lubricant available from WD40 Co., Ltd., U.K.) and oleic acid as a representative greasy contaminant. Their relative surface activity is such that Nalco 2341 TM > WD40 TM > oleic acid. Again, by examining which coatings exhibited repellency and which did not, a measure was obtained of the relative ability of the coating aid to provide protection against the surface active contaminants.

The results are presented in Table 2.

TABLE 2

| Compound | Concn. (wt %) | Nalco 2341 TM | WD40 TM | Oleic acid |
|---|---|---|---|---|
| A | 0.2 | R | R | C |
| (invention) | 0.3 | R | R | C |
| | 0.4 | C | C | C |
| | 0.5 | C | C | C |
| B | 0.2 | R | R | R |
| | 0.3 | R | R | R |
| | 0.4 | R | R | R |
| | 0.5 | R | R | C |
| C | 0.3 | R | R | R |
| (invention) | 0.5 | C | C | C |
| D | 0.2 | | C | |
| (invention) | 0.4 | C | | |
| | 0.5 | C | | |
| E | 0.2 | | R | |
| | 0.4 | R | | |
| | 0.5 | R | | |

As before, R denotes that the surface active contaminant produced a repellency while C denotes that no repellency was produced.

The results presented in Table 2 demonstrate the extra protection afforded by the surface active agents used in the invention relative to the comparison compounds. For concentrations below 0.5 wt %, only the compounds used in the invention are capable of preventing repellency with the Nalco 2341 TM antifoam contaminant.

EXAMPLE 3

Two gelatin layers, the uppermost of which contained the coating aid under test, were coated onto a polyethylene terephthalate film base subbed to give adhesion to gelatin. The bottom layer consisted of a 4% by weight solution of lime-processed bone gelatin in water coated at 85.4 ml/m$^2$. The top layer consisted of a 7% by weight solution of lime-processed bone gelatin in water containing a colored dye marker. The top layer was applied at a coverage of 14.2 ml/m$^2$. Both layers were applied simultaneously at a temperature of 40° C.

using a conventional double slide hopper with applied suction and a linear coating speed of 30 m/min.

Impact charge measurements were made by briefly impacting a stainless steel electrode of 11.3 mm diameter against the test coating at a pressure of 1.4 kg/cm$^2$. The residual charge on the coating was then assessed with an electrometer at a temperature of 20° C. and at both 20% and 50% relative humidity (RH).

The results are shown in Table 3.

TABLE 3

| Compound | Concn. (wt %) | Average Impact Charge Value (esu/cm$^2$) 20% RH | 50% RH |
|---|---|---|---|
| A' (invention) | 0.1 | −10 | −17 |
| B' (comparison) | 0.3 | −5.7 | −3.5 |
| C (invention) | 0.1 | −17 | −19 |
| D (invention) | 0.1 | −16 | −16 |
| E (comparison) | 0.1 | −1.9 | −2.4 |

The results show that the surface active agents used in the invention produce more negative charging than the compounds tested for comparison. Hence the latitude of variation of charging characteristics that can be obtained when such materials are mixed with positive charge inducing compounds is wider with the surface active agents used in the invention.

Light-sensitive photographic silver halide materials e.g. an X-ray material have been produced wherein the outermost protective layer has been coated from a coating composition according to the invention.

We claim:

1. A coating composition comprising an aqueous solution of a hydrophilic colloid and a surface active agent present as a coating aid characterized in that the surface active agent is present in an amount of 0.01 to 0.5 percent by weight of the composition and has the formula:

$$CF_3(CF_2)_nCH_2O(\text{glycidyl})_mH$$

wherein n is an integer from 4 to 7; and, m is an integer from 6 to 45.

2. A composition according to claim 1 wherein the surface active agent has the formula given in which n is 5 and m is an integer from 10 to 20.

3. A composition according to claim 1 or claim 2 wherein the hydrophilic colloid is gelatin.

4. A composition according to claim 1 or claim 2 further comprising a positive charge inducing surface active agent.

* * * * *